US009669527B2

(12) United States Patent
Ho et al.

(10) Patent No.: US 9,669,527 B2
(45) Date of Patent: Jun. 6, 2017

(54) DIGITAL TORQUE WRENCH

(71) Applicant: NATIONAL KAOHSIUNG UNIVERSITY OF APPLIED SCIENCES, Kaohsiung (TW)

(72) Inventors: Shine-Tzong Ho, Kaohsiung (TW); Bo-Yi Zhuang, Taichung (TW)

(73) Assignee: National Kaohsiung University of Applied Sciences, Kaohsiung (TW)

( * ) Notice: Subject to any disclaimer, the term of this patent is extended or adjusted under 35 U.S.C. 154(b) by 304 days.

(21) Appl. No.: 14/556,376

(22) Filed: Dec. 1, 2014

(65) Prior Publication Data

US 2015/0328756 A1 Nov. 19, 2015

(30) Foreign Application Priority Data

May 16, 2014 (TW) ..... 103117333 A

(51) Int. Cl.
*B25B 23/142* (2006.01)

(52) U.S. Cl.
CPC ..... *B25B 23/1427* (2013.01); *B25B 23/1422* (2013.01); *B25B 23/1425* (2013.01)

(58) Field of Classification Search
CPC ..... B25B 23/1427; B25B 23/1422; B25B 23/1425
See application file for complete search history.

(56) References Cited

U.S. PATENT DOCUMENTS

| | | | | |
|---|---|---|---|---|
| 6,276,243 | B1 | 8/2001 | Jenkins | |
| 6,526,853 | B2 | 3/2003 | Jenkins | |
| 8,171,828 | B2 * | 5/2012 | Duvan | B25B 13/462 73/862.21 |
| 8,245,606 | B2 * | 8/2012 | Chiang | B25B 23/1427 73/862.21 |
| 8,371,194 | B2 * | 2/2013 | Wu | B25B 23/1427 81/467 |
| 8,443,702 | B2 * | 5/2013 | Kan | B25B 13/465 81/467 |
| 2007/0227316 | A1 * | 10/2007 | Lucke | B25B 23/1425 81/478 |

* cited by examiner

*Primary Examiner* — David B Thomas
(74) *Attorney, Agent, or Firm* — Rosenberg, Klein & Lee

(57) ABSTRACT

A digital torque wrench mainly comprises a transmission rod of wrench body provided in a handle, and a tool head provided at the exterior of the handle. An abutment surface on the other end of the transmission rod is to abut with one end of a lever arm. A roller is provided on the other end of the lever arm, and a rolling member opposite to the roller is also provided. A latch member on an actuator is inserted between the roller and the rolling member. Further, a controller is coupled with the actuator and a torque sensing element.

19 Claims, 15 Drawing Sheets

DIGITAL TORQUE WRENCH

BACKGROUND OF INVENTION

Field of the Invention

The present invention relates to a digital torque wrench, more particularly to a digital torque wrench which is handy to preset a torque value and can release precisely when the torque applied to a fastener reaches the preset torque value.

Brief Description of Prior Art

Referring to U.S. Pat. No. 6,119,562, U.S. Pat. No. 6,276,243 and U.S. Pat. No. 6,526,853, the torque wrench in each case substantially comprises a release mechanism provided therein. The release mechanism mainly employs a linkage formed by a number of levers to carry out the release action. If applied torque exceeds preset torque value, when the torque wrench is used to tighten a bolt, the release mechanism will conduct release action so that the torque wrench becomes ineffective in tightening. However, this release mechanism in implementation has the problems of slow response action among the levers, taking much more force and sluggishness in performing release action. Moreover, the release action becomes unreliable due to aging, deformation or elastic fatigue of a restoring spring after using for a period of time. Furthermore, when the preset torque value is about to be reached, the counter moment of the linkage of the release mechanism will drop down sometimes. At this moment, if too much force is applied, the torque value will quickly rise again and go beyond an upper limit value to cause torque value error. This will result in unreliable tightening of fastener.

SUMMARY OF THE INVENTION

The present invention relates to a digital torque wrench, the main object of the present invention is to provide a digital torque wrench which is handy to preset a torque value and can release precisely when the torque applied to a fastener reaches the preset torque value.

In order to achieve above object, the inventor of the present invention proposes following digital torque wrench. The digital torque wrench of the present invention mainly comprises; a transmission rod of wrench main body provided in a handle; and a tool head, which is connected with the transmission rod, provided at an exterior of the handle. An abutment surface is provided on the other end of the transmission rod for abutting with one end of a lever arm of the release mechanism. A roller is provided on the other end of the lever arm, and a rolling member is also provided oppositely to the roller. A latch member assembled on an actuator is inserted between the roller and the rolling member. Further, a controller is coupled with the actuator and a torque sensing element provided on the transmission rod. In this way, when the torque sensed by the torque sensing element is consistent with the preset torque vale, the controller drives the actuator so that the latch member retracts from the place between the roller and the rolling member so as to release the contact of the lever arm from the abutment surface of the transmission rod, and then the wrench main body is out of the function of tightening the fastener such as a bolt. In this manner, the release mechanism is designed to be electrically controlled so as to achieve precise control on torque value.

BRIEF DESCRIPTION OF ACCOMPANYING DRAWINGS

DETAILED DESCRIPTION OF PREFERRED EMBODIMENTS

Figure 1:
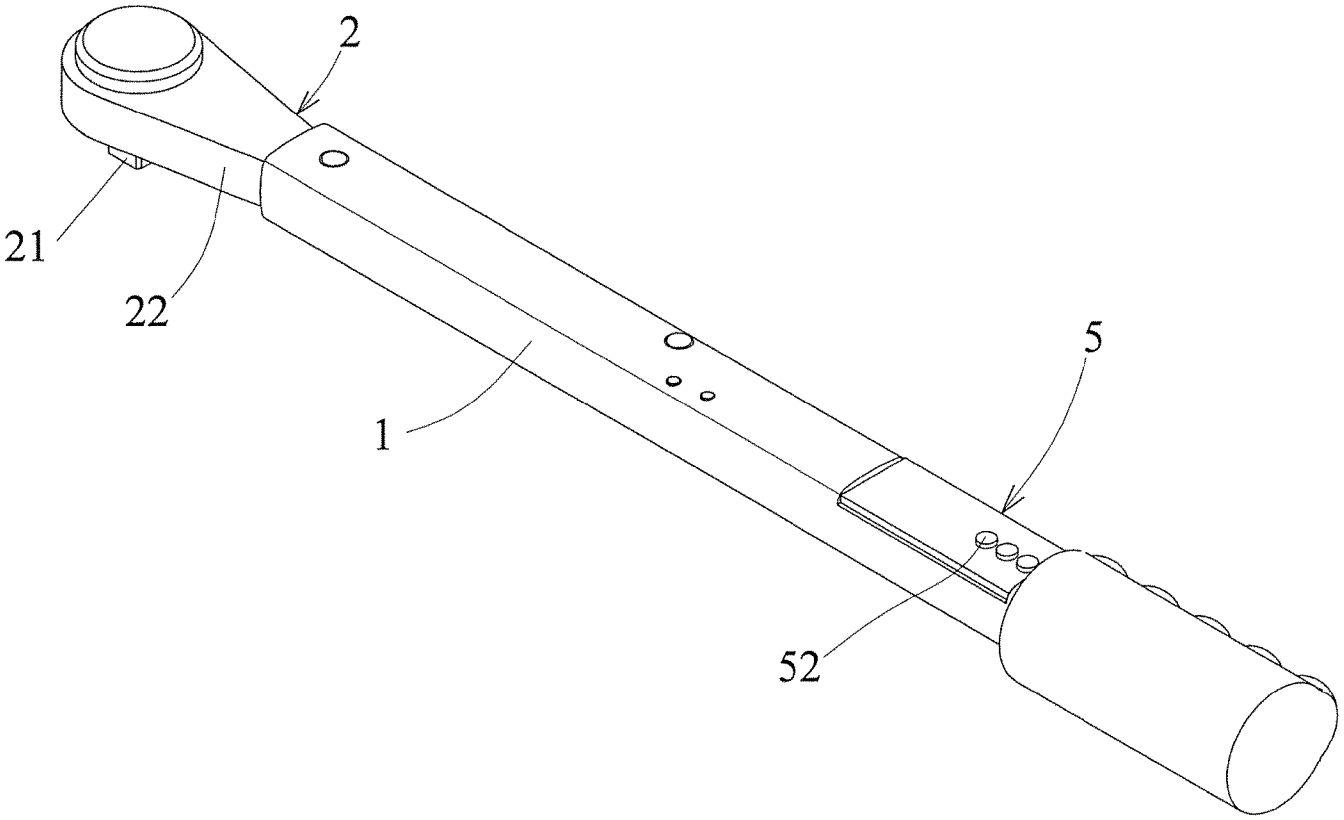
FIG. 1 is a perspective view showing the appearance of the present invention.
Figure 2:
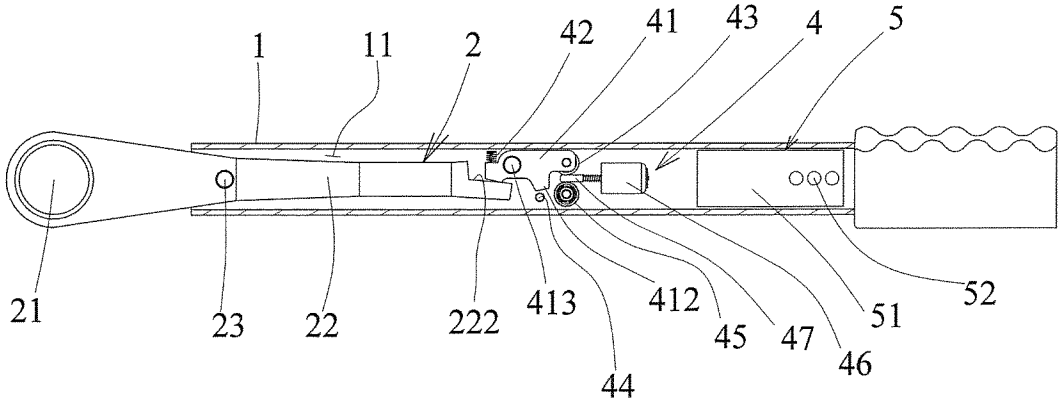
FIG. 2 is an overall sectional view of the present invention.
Figure 3:
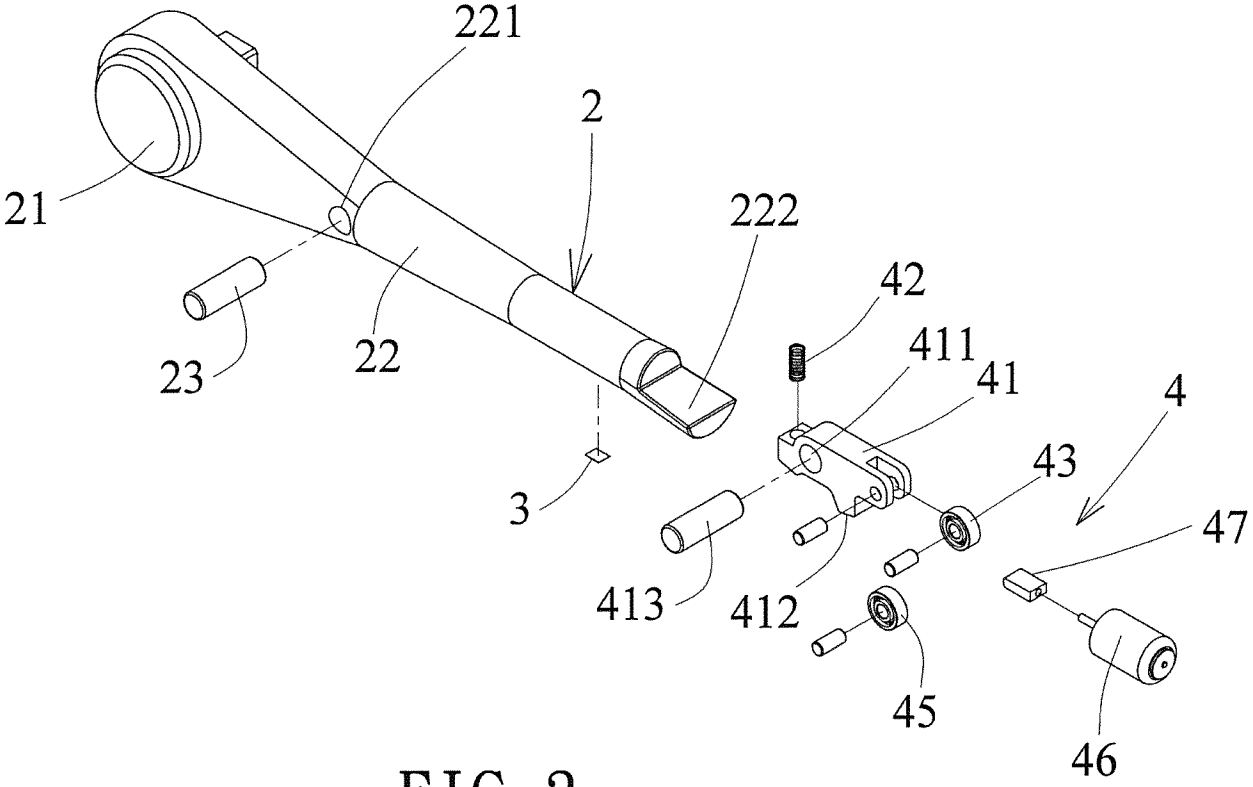
FIG. 3 is a perspective exploded view of the present invention.
Figure 4:
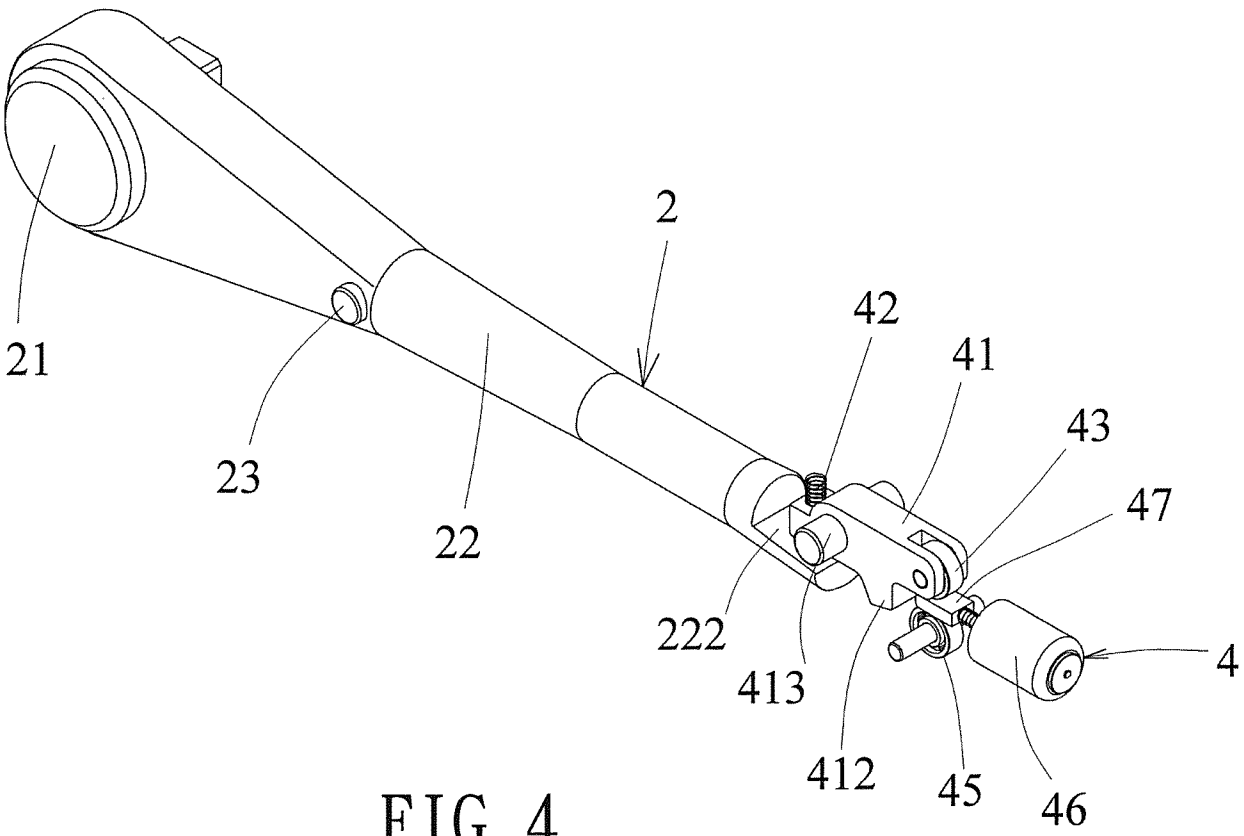
FIG. 4 is a perspective assembly view of the present invention.
Figure 5:
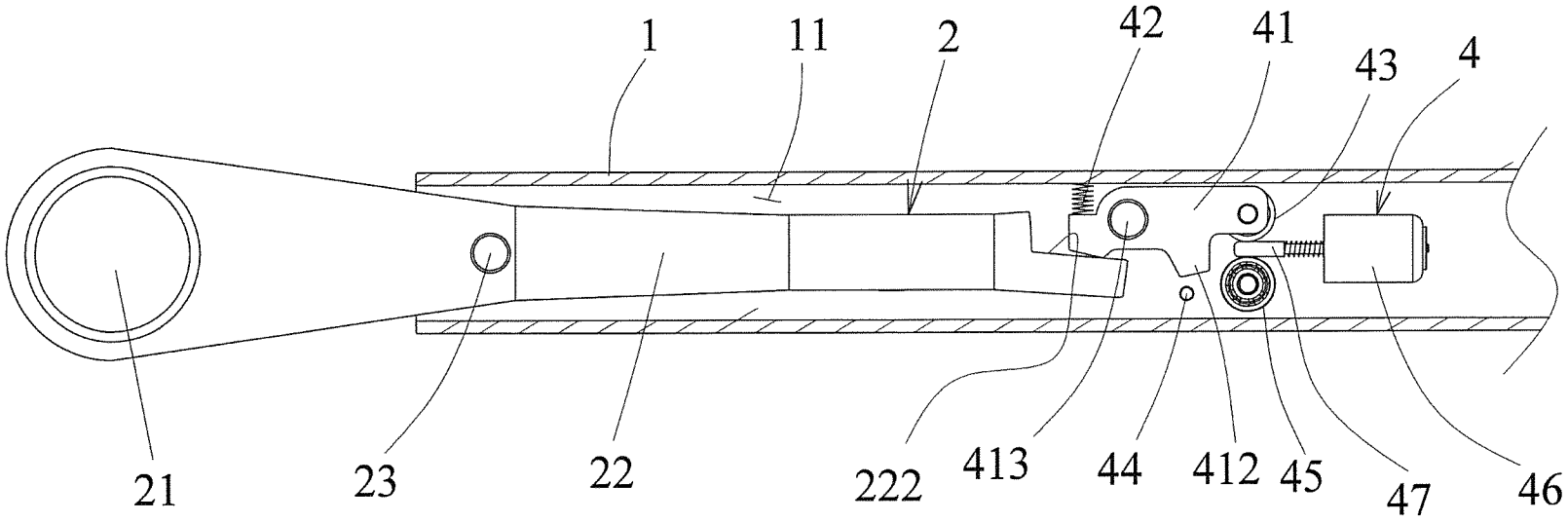
FIG. 5 is a sectional view of the present invention.

The objects, the technical contents and the expected effect of the present invention will become more apparent from the detailed description of preferred embodiments in conjunction with the accompanying drawings.

Firstly as shown in FIGS. 1 to 5, the digital torque wrench of the present invention comprises a handle 1, a wrench main body 2, a torque sensing element 3, a release mechanism 4 and a control unit 5.

The handle 1 is a hollow tubular body which has an accommodation space 11 formed therein.

The wrench main body 2 is provided with a tool head 21 which is located at an exterior of the handle 1. The tool head 21 is connected with one end of a transmission rod 22 which is received within the accommodation space 11 of the handle 1. The transmission rod 22 and the handle 1 are respectively provided with corresponding through holes 221 for pivotal penetration of a pin 23. The other end of the transmission rod 22 is formed with a flat abutment surface 222.

The torque sensing element 3 is a strain gauge which is assembled on the transmission rod 22 of the wrench main body 2.

The release mechanism 4 is received within the accommodation space 11 of the handle 1 and is located on one end of the abutment surface 222 of the transmission rod 22 of the wrench main body 2. The release mechanism 4 includes a lever arm 41 one end of which abuts against the abutment surface 222 of the transmission rod 22. A spring member 42 is assembled between the one end of the lever arm 41 abut against the abutment surface 222 and the handle 1. A roller 43, which is a bearing in this case, is assembled on the other end of the lever arm 41. A through hole 411 is further provided between both ends of the lever arm 41, and a through hole corresponding to the through hole 411 is also provided on the handle 1 so that a pin 413 can be pivotally connected to the through holes. Further, the lever arm 41 is formed with a protruding portion 412 on the other side opposite to the spring member 42, and the protruding portion 412 abuts against a corresponding stop bar 44 provided on the handle 1. A rolling member 45 is provided opposite to the roller 43, and a shaft passing through the center of the rolling member 45 is assembled on the handle 1. The rolling member 45 can be one or several bearing(s) arranged parallel to each other. Furthermore, an actuator 46, which in this case is a solenoid valve, is provided and a latch member 47 is provided on the transmission shaft of the actuator 46, and the latch member 47 is inserted between the roller 43 and the rolling member 45.

Figure 6:
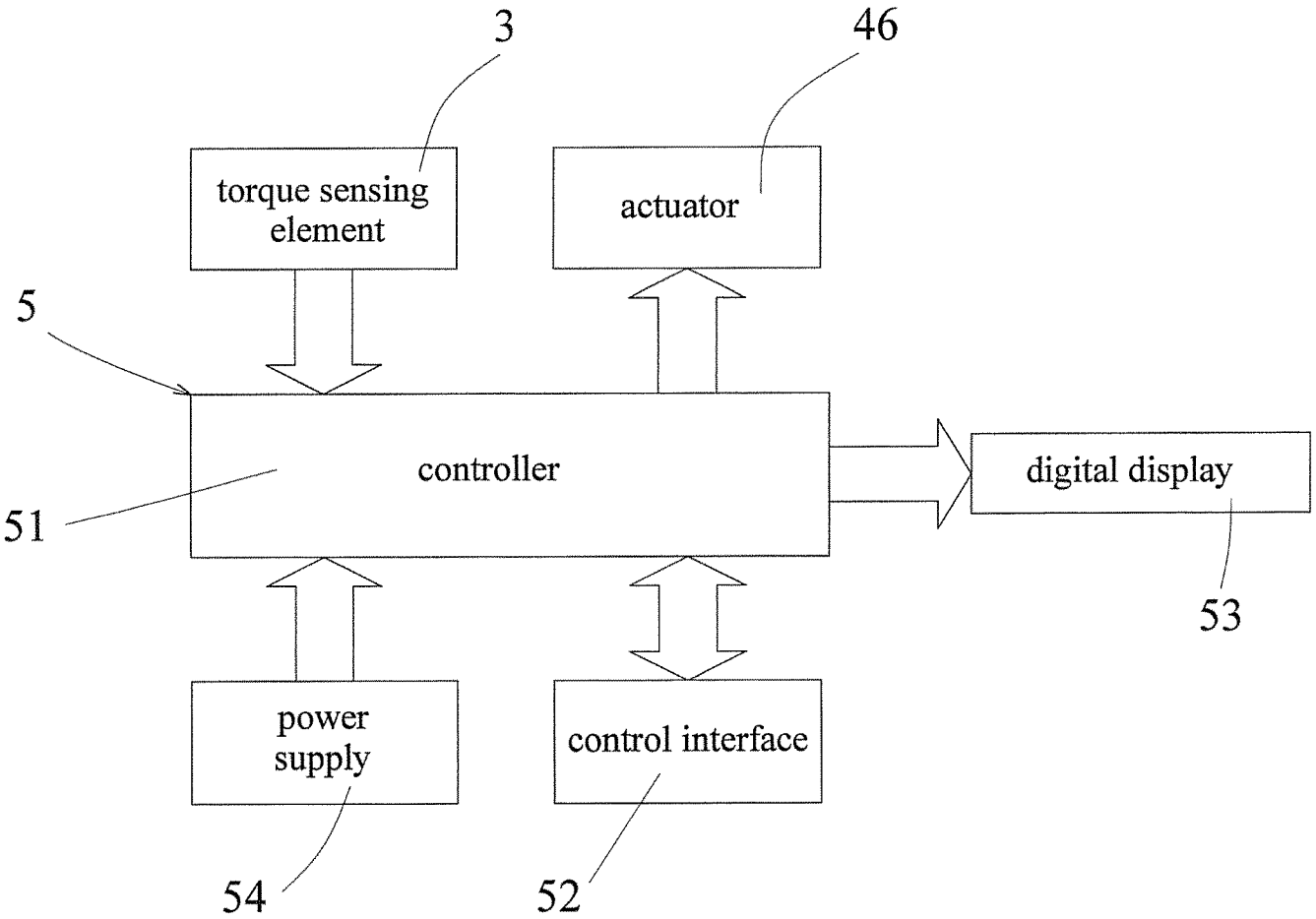
FIG. 6 is a schematic view showing the control unit of the present invention.

The control unit 5 includes a controller 51 provided within the accommodation space 11 of the handle 1, as shown in FIG. 6. The control unit 5 is coupled to the torque sensing element 3 and the actuator 46 of the release mechanism 4. Further, a control interface 52 and a digital display 53 are located on the exterior of the handle 1 and the control interface 52 and the digital display 53 are coupled to the controller 51. Moreover, a power supply 54 such as battery received within the accommodation space 11 of the handle 1 is coupled to the controller 51.

Figure 7:
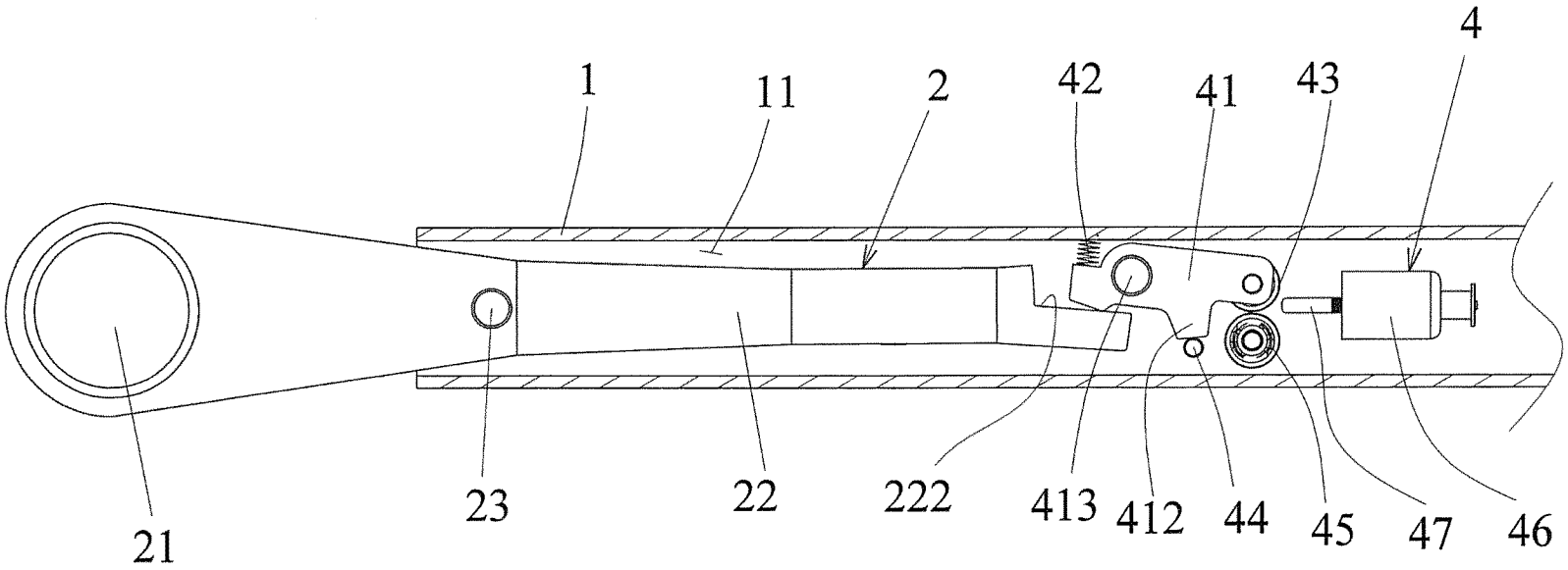
FIG. 7 is a view of the present invention in use state.

In this way, when the digital torque wrench is in use, user can inputs a preset torque value from the control interface 52 of the control unit 5 to the controller 51, and the torque value is shown on the display 53 for user's confirmation. After the input of the torque value, user can grip the handle 1 of the digital torque wrench, and then fits the tool head 21 of the wrench main body 2 to a fastener such as a bolt. Then, user applies a force to turn the digital torque wrench so as to tighten the fastener. When the tool head 21 applies a torque to tighten the fastener, the transmission rod 22 integrally connected with the tool head 21 is simultaneously subject to a reaction of the torque. At this moment, the torque sensing element 3 on the transmission rod 22 can sense the torque value and output the sensed torque value to the digital display 53 through the controller 51. If the torque value output from the torque sensing element 3 to the controller 51 is consistent with the preset torque value, referring to FIG. 7, the controller 51 drives the actuator 46 of the release mechanism 4 so that the actuator 46 retracts the latch member 47 coupled with the actuator 46 from the place between the roller 43 and the rolling member 45. At this moment, the end of the lever arm 41 combined with the roller 43 will drop down and contact with the rolling member 45, so that the other end of the lever arm 41 originally abut against the abutment surface 222 of the transmission rod 22 of the wrench main body 2 is lifted upward to escape from the contact with the abutment surface 222 with the pin 413 of the lever arm 41 as the fulcrum, and the spring member 42 assembled on one side of the lever arm 41 is recovered to its original shape, and the protruding portion 412 on the other side of the lever arm 41 will contact with the stop bar 44.

After one end the transmission rod 22 of the wrench main body 2 is out of the abutment with the lever arm 41, when the tool head 21 connected with the other end of the transmission rod 22 again conducts tightening action of the fastener such as a bolt, as the one end of the transmission rod 22 originally limited by the lever arm 41 is now in movable state, the transmission rod 22 swings with the pivot pivotally connected by the pin 23 of the handle 1 as the fulcrum, so that the tool head 21 is out of the function of tightening the fastener such as a bolt. In this manner, the fastener such as a bolt can be firmly tightened, and over-tightening can be avoided so that the thread of the fastener can be prevented from breaking. Moreover, the present invention controls the release mechanism 4 by electrical control method so that the maximum torque value applied to tighten the fastener can be precisely controlled. The design of clamping the latch member 47 by the roller 43 and the rolling member 45 can further lower the frictional resistance during the retraction of the latch member 47, so that the release action of the release mechanism 4 becomes more labor-saving and smooth, even the release function can be achieved by smaller actuator so that the overall weight of the wrench and power consumption can be reduced. Moreover, as the present invention conducts presetting by digital system, instead of using mechanical type release mechanism which involves complicated adjustment and correction procedures, so that preset torque value can be adjusted in labor-saving and time-saving condition.

Figure 8:
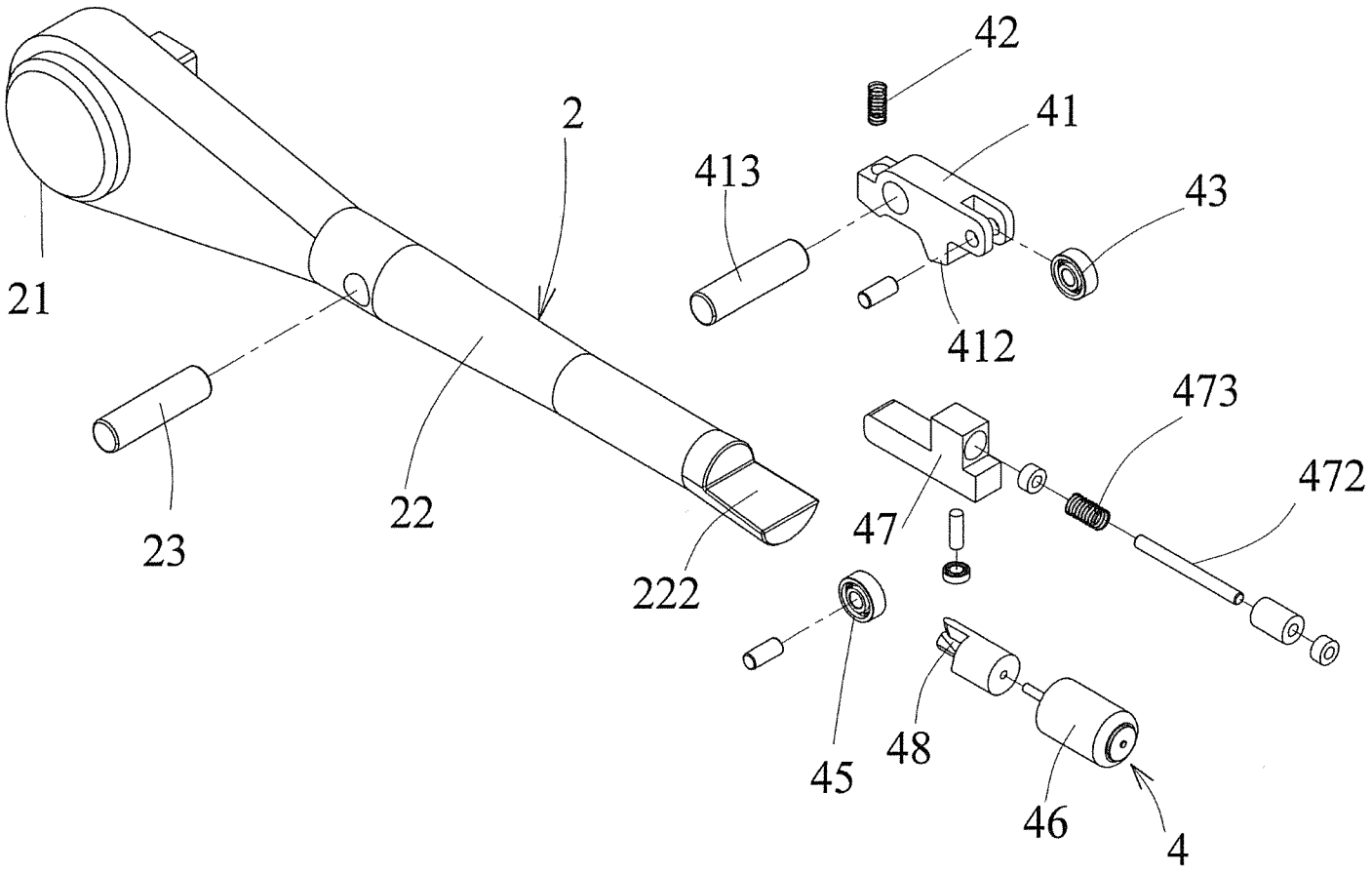
FIG. 8 is a perspective exploded view of the second embodiment of the present invention.
Figure 9:
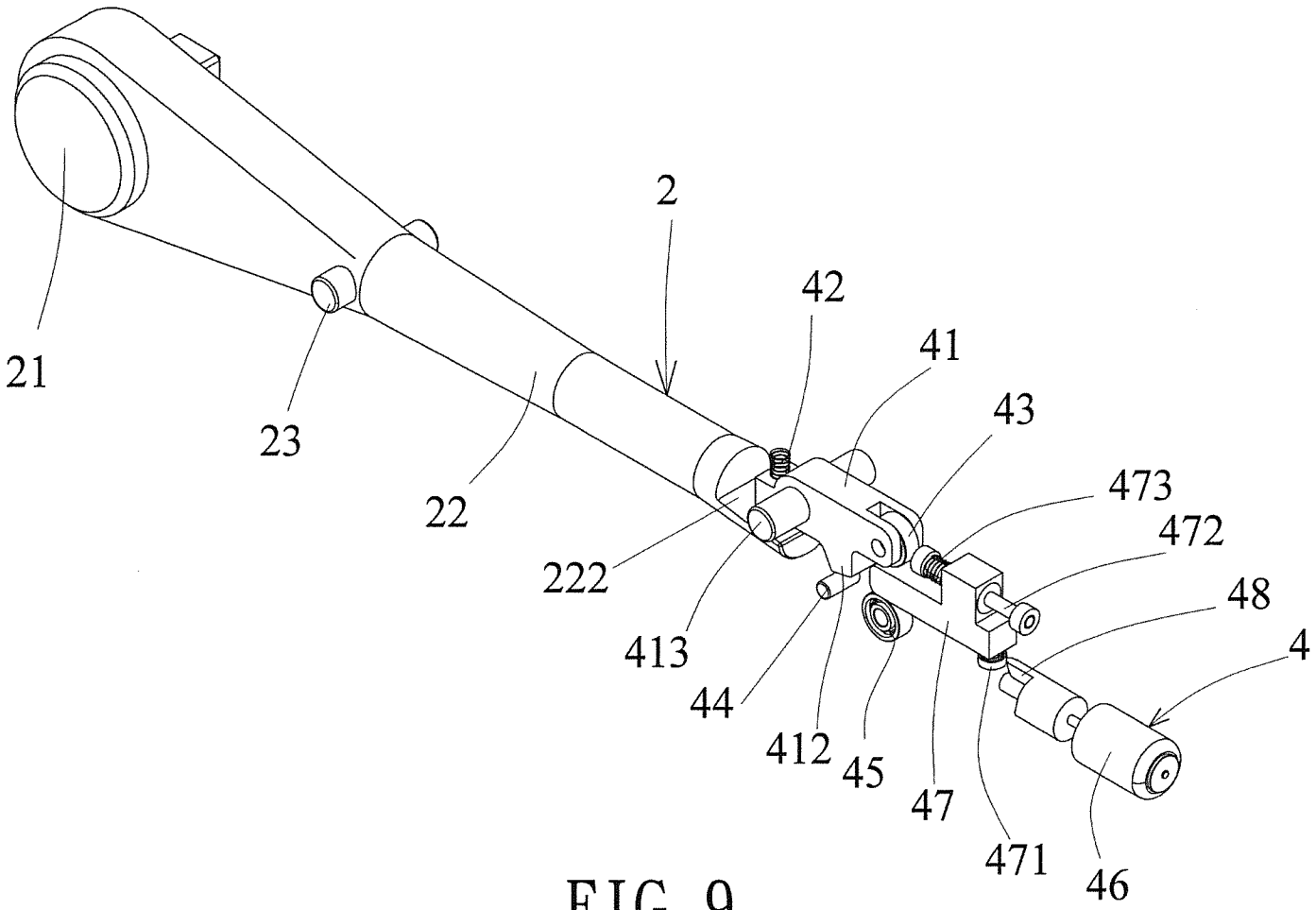
FIG. 9 is a perspective assembly view of the second embodiment of the present invention.
Figure 10:
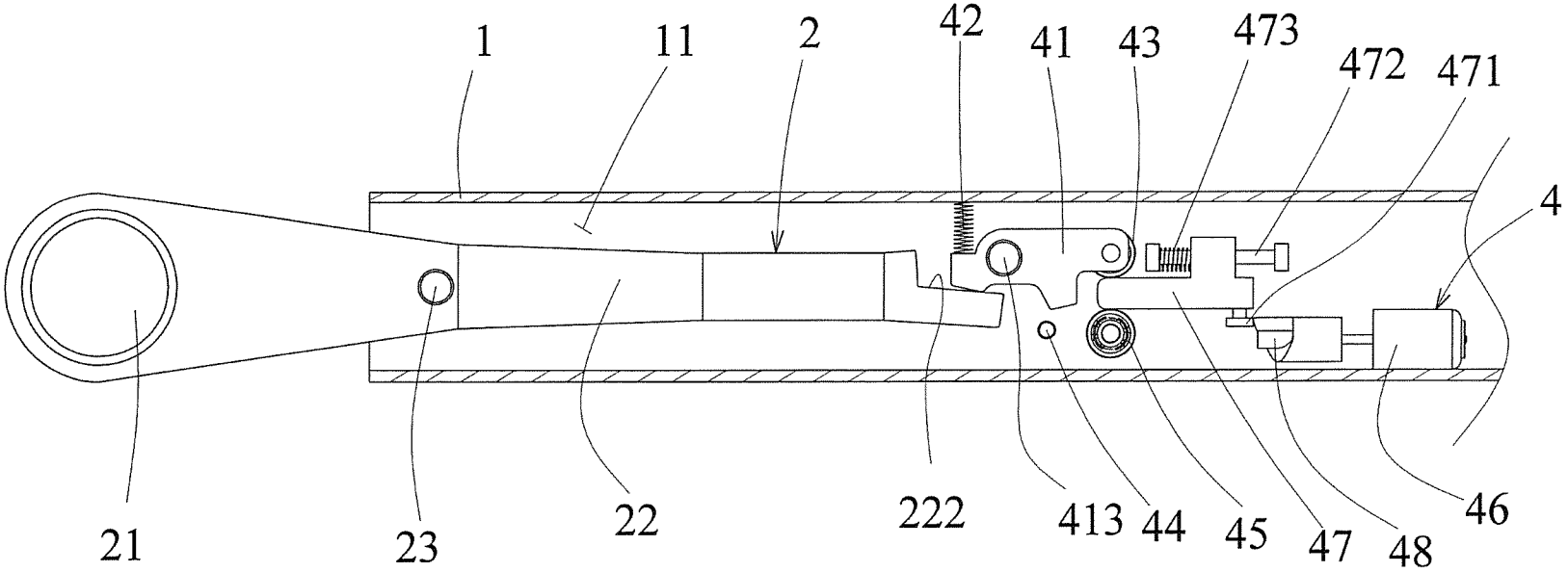
FIG. 10 is a sectional view of the second embodiment of the present invention.
Figure 11:
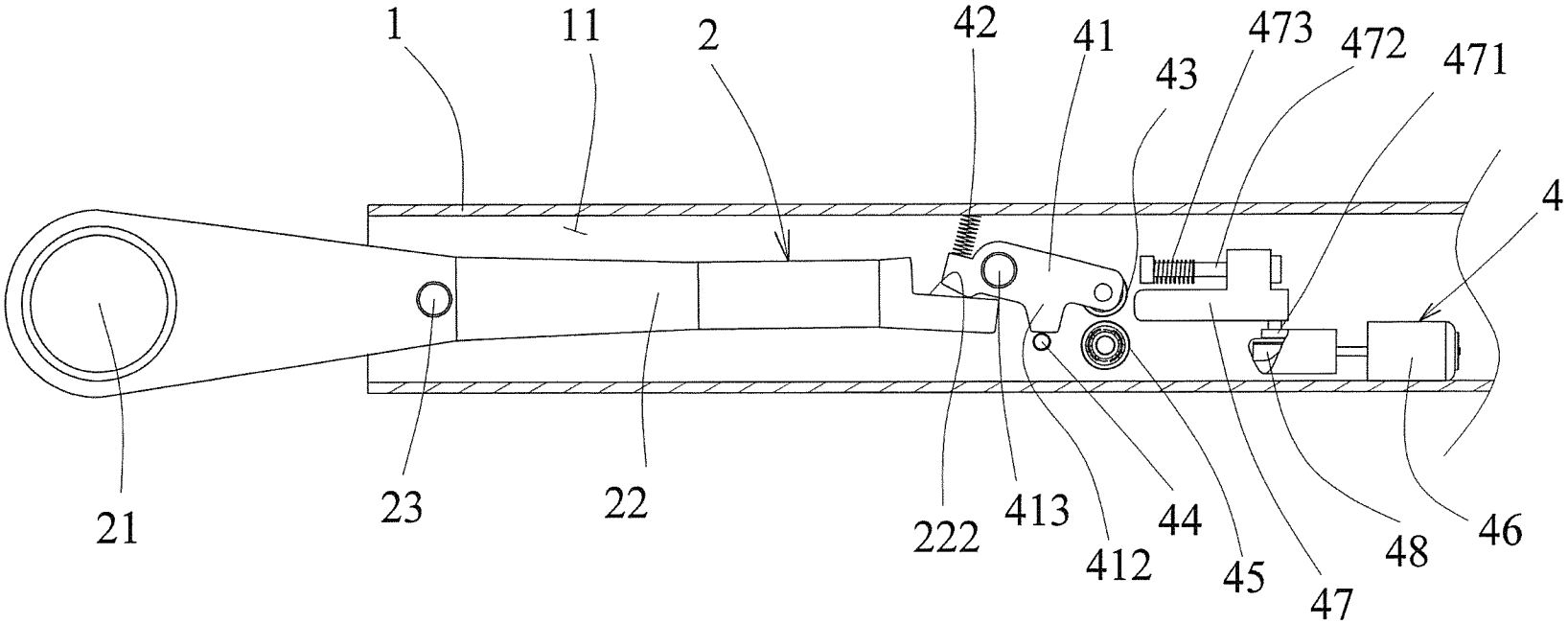
FIG. 11 is a view of the second embodiment of the present invention in use state.

Referring together to FIGS. 8 to 10, a second embodiment of the release mechanism 4 of the digital torque wrench of the present invention is shown. In this embodiment, the actuator 46 is a motor and the transmission shaft of the actuator 46 is provided with a cam 48 the type of which is an end cam. Further, the latch member 47 is provided with a follower 471 so as to be in contact with the cam 48. A guide hole is provided on the latch member 47 so as to allow a pilot bar 472 assembled on the handle 1 to go through. A spring member 473 is fitted over the pilot bar 472 and is located between the terminal head of the pilot bar 472 and the latch member 47. Referring together to FIG. 11, when the controller 51 compares the torque value sensed by the torque sensing element 3 and the preset value to be consistent, the controller 51 drives the motor actuator 46 coupled therewith, so that the transmission shaft of the actuator 46 drives the cam 48 to rotate a predetermined angle. At this moment, the follower 471, originally contacted on the lifting stroke segment will move along the curve of the cam 48 and then down to the base circle of the cam 48. Simultaneously, the spring member 473 located between the terminal head of the pilot bar 472 and the latch member 47 is out of the abutment against the lifting stroke segment and recovers to original shape and pushes the latch member 47 to be out of the clamping between the roller 43 and the rolling member 45, and then allows the lever arm 41 to swing so as to release the locking of the wrench main body 2. Therefore, the tool head 21 of the wrench main body 2 is out of the function of tightening the fastener such as a bolt.

Figure 12:
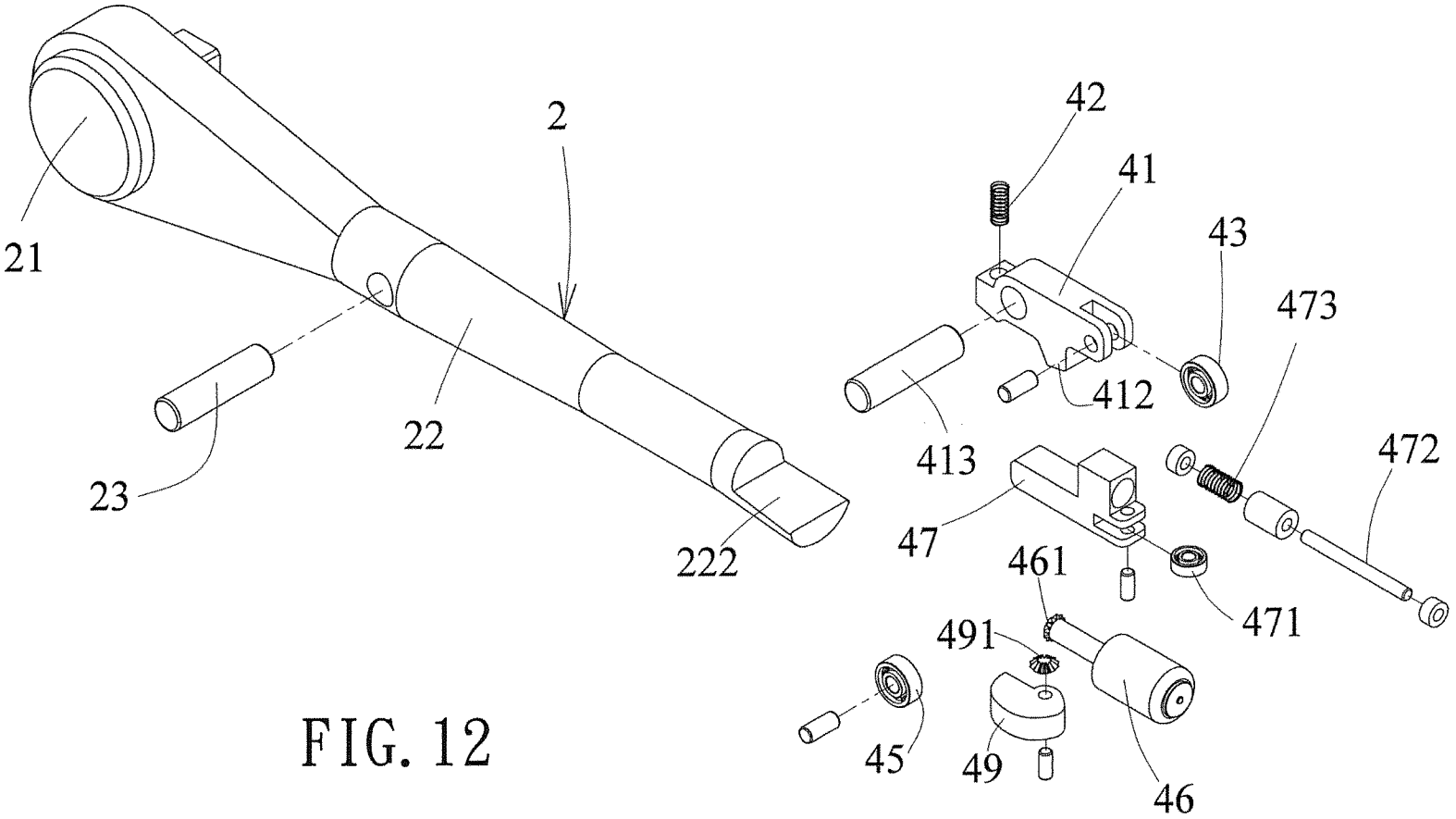
FIG. 12 is a perspective exploded view of the third embodiment of the present invention.
Figure 13:
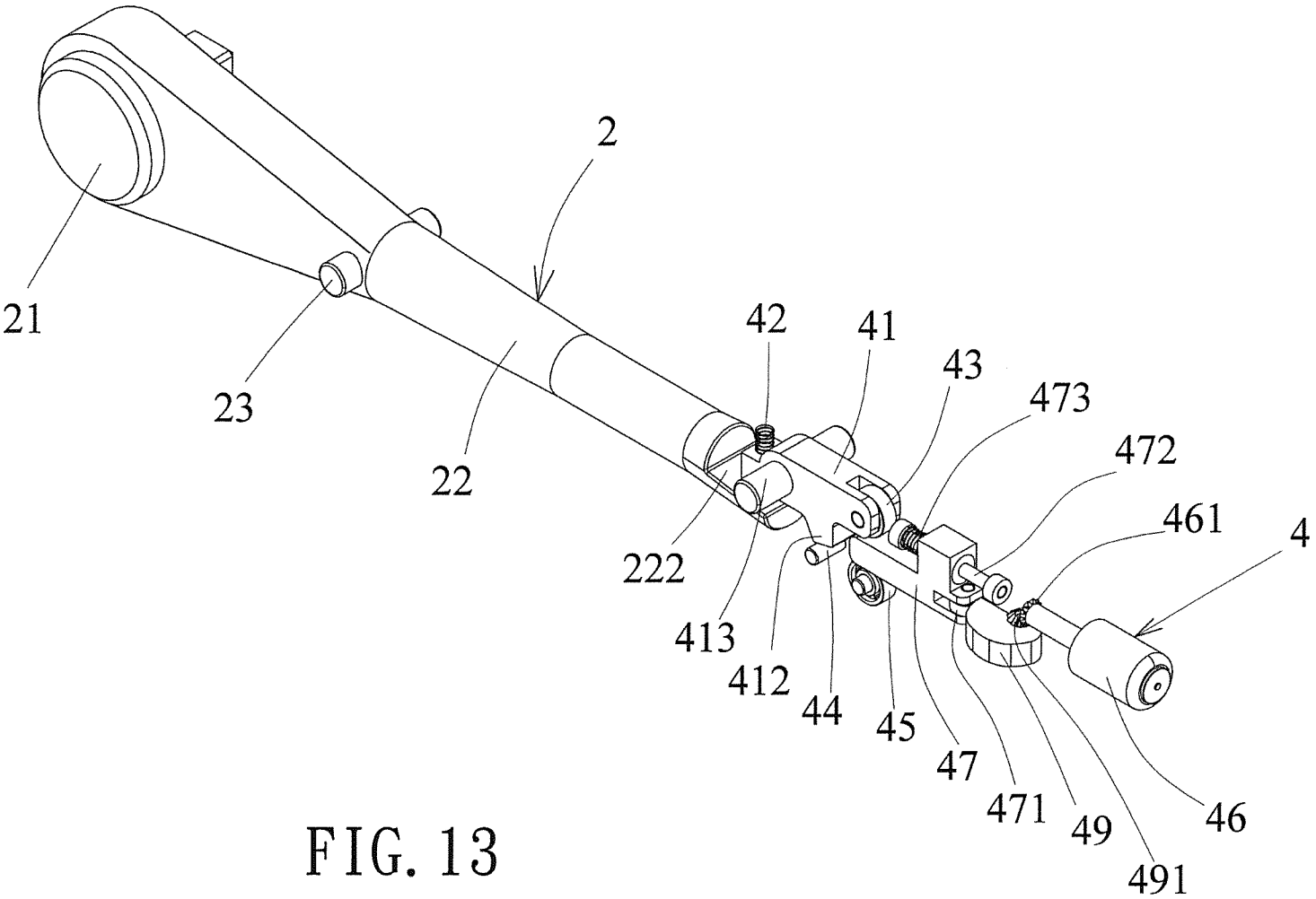
FIG. 13 is a perspective assembly view of the third embodiment of the present invention.
Figure 14:
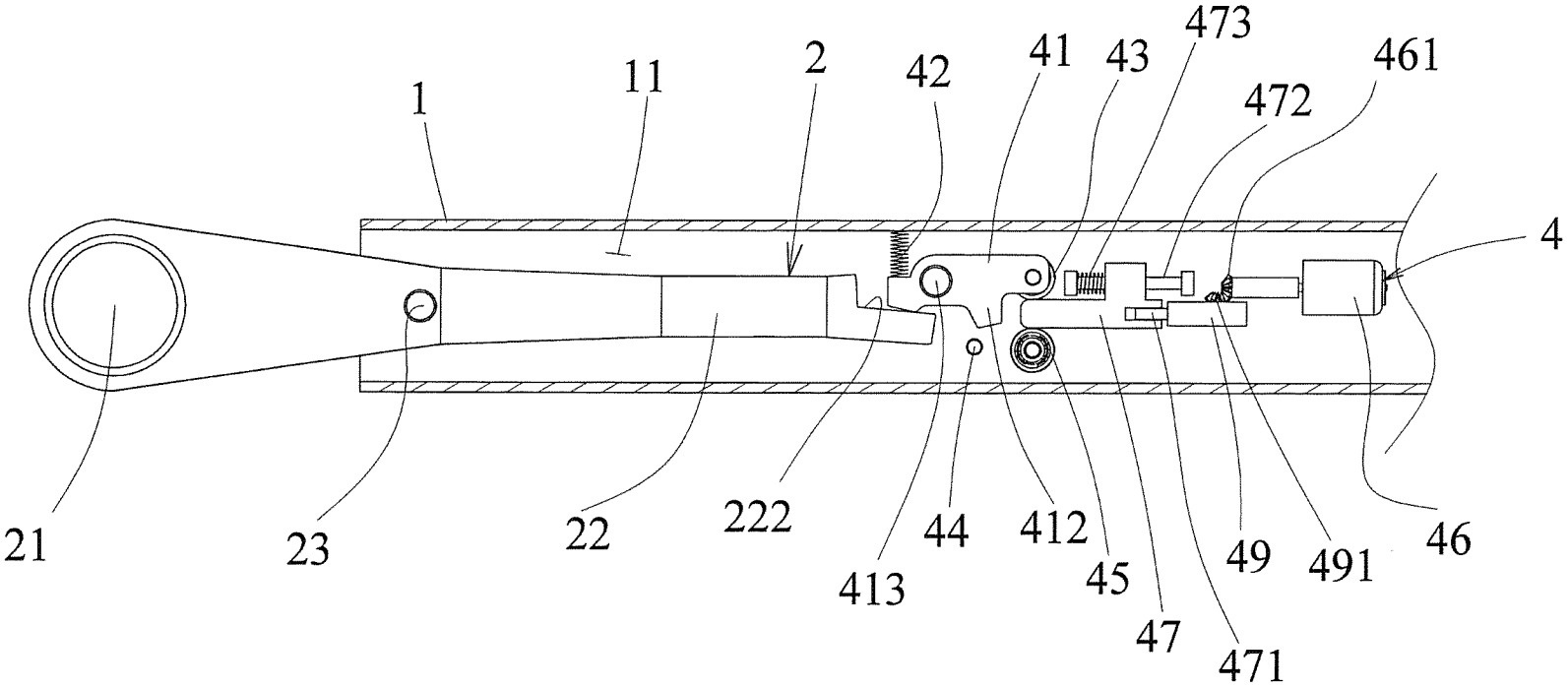
FIG. 14 is a sectional view of the third embodiment of the present invention.
Figure 15:
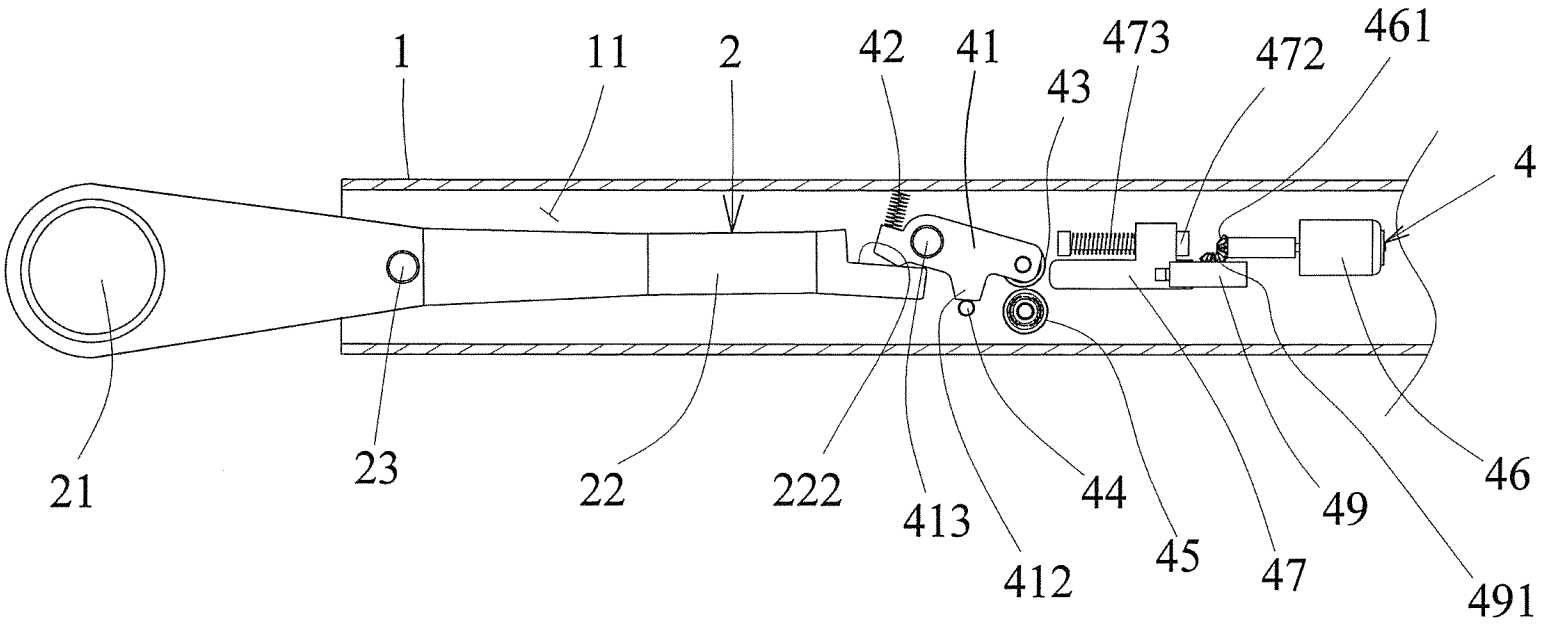
FIG. 15 is a view of the third embodiment of the present invention in use state.

Further referring to FIGS. 12 to 14, a third embodiment of the release mechanism 4 of the digital torque wrench of the present invention is shown. In this embodiment, the transmission shaft of the motor actuator 46 is assembled with a bevel gear 461, and is provided with a cam 49 which is a plate type cam, and a bevel gear 491 is formed on the cam 49 for meshing with the bevel gear 461 of the actuator 46. Furthermore, the latch member 47 is provided with a follower 471 to abut the cam 49. A guide hole is provided on the latch member 47 so as to allow a pilot bar 472 assembled on the handle 1 to go through. A spring member 473 is fitted over the pilot bar 472 and is located between one terminal head of the pilot bar 472 and the latch member 47. Referring together to FIG. 15, when the controller 51 compares the torque value sensed by the torque sensing element 3 and the preset value to be consistent, the controller 51 drives the motor actuator 46 coupled therewith, so that the transmission shaft of the actuator 46 drives the bevel gear 461 to rotate, and in turn moves the bevel gear 491 on the cam 49 meshed together to rotate the cam 49 to a predetermined angle. Therefore, the follower 471 originally abut on the lifting stroke segment of the cam 49 will move along the curve of the cam 49 and then down to the base circle of the cam 49. Simultaneously, the spring member 473 located between the terminal head of the pilot bar 472 and the latch member 47 gradually recovers to original shape and pushes the latch member 47 to be out of the clamping between the roller 43 and the rolling member 45 so as to allow the lever arm 41 to swing, and then release the locking of the wrench main body 2. When the tool head 21 provided on one end of the wrench main body 2 applies a torque to lock the fastener, the other end of the wrench main body 2 is movable to swing so as to be out of the function of tightening the fastener such as a bolt.

What is claimed is:

1. A digital torque wrench, comprising:

a handle having an accommodation space formed therein;

a wrench main body provided with a tool head which is located at an exterior of the handle, the tool head is connected to one end of a transmission rod which is received in the accommodation space of the handle, and the transmission rod is pivotally connected with the handle; the other end of the transmission rod is formed with an abutment surface;

a torque sensing element assembled on the transmission rod of the wrench main body;

a release mechanism received within the accommodation space of the handle, and the release mechanism is located at one end of the abutment surface of the transmission rod of the wrench main body; the release mechanism includes a lever arm which is pivotally connected with the handle; one end of the lever arm is correspondingly in contact with the abutment surface of the transmission rod; a roller is assembled to the other end of the lever arm and at least one rolling member opposite to the roller is assembled on the handle; an actuator is further provided, the transmission shaft of which is assembled with a latch member, and the latch member is inserted between the roller and the rolling member; and a control unit including a controller provided on the handle, and the controller is coupled with the torque sensing element and the actuator of the release mechanism; a control interface and a digital display are provided on the exterior of the handle and the control interface and the digital display are coupled with the controller;

wherein the lever arm of the release mechanism has a spring member provided on one end which abuts against the abutment surface of the transmission rod of the wrench main body, and the spring member is assembled between one side of the lever arm and the handle.

2. The digital torque wrench as claimed in claim 1, wherein the lever arm of the release mechanism is formed with a protruding portion on the other side opposite to the spring member, and the protruding portion abuts against a corresponding stop bar provided on the handle.

3. The digital torque wrench as claimed in claim 1, wherein the controller is further provided with a power supply assembled in the handle, and the power supply is coupled with the controller.

4. The digital torque wrench as claimed in claim 1, wherein the torque sensing element is a strain gauge.

5. The digital torque wrench as claimed in claim 1, wherein the roller and the rolling member are bearings.

6. The digital torque wrench as claimed in claim 1, wherein the release mechanism includes a plurality of rolling members, the rolling members being arranged parallel to each other.

7. A digital torque wrench, comprising:

a handle having an accommodation space formed therein;

a wrench main body provided with a tool head which is located at an exterior of the handle, the tool head is connected to one end of a transmission rod which is received in the accommodation space of the handle, and the transmission rod is pivotally connected with the handle; the other end of the transmission rod is formed with an abutment surface;

a torque sensing element assembled on the transmission rod of the wrench main body;

a release mechanism received within the accommodation space of the handle, and the release mechanism is located at one end of the abutment surface of the transmission rod of the wrench main body; the release mechanism includes a lever arm which is pivotally connected with the handle; one end of the lever arm is correspondingly in contact with the abutment surface of the transmission rod; a roller is assembled on the other end of the lever arm and at least one rolling member opposite to the roller is assembled on the handle; an actuator is further provided, the transmission shaft of which is assembled with a cam, and is further provided with a latch member, and a follower is assembled on the latch member so as to engage with the cam; a guide hole is provided on the latch member so as to allow a pilot bar assembled on the handle to go through; a spring member is fitted over the pilot bar and the spring member is located between the terminal head of the pilot bar and the latch member; and the latch member is inserted between the roller and the rolling member; and a control unit including a controller assembled on the handle, and the controller is coupled with the torque sensing element and the actuator of the release mechanism; a control interface and a digital display are provided on the exterior of the handle, and the control interface and the digital display are coupled with the controller.

8. The digital torque wrench as claimed in claim 7, wherein the lever arm of the release mechanism has a spring member provided on one end which abuts against the abutment surface of the transmission rod of the wrench main body, and the spring member is assembled between one side of the lever arm and the handle.

9. The digital torque wrench as claimed in claim 8, wherein the lever arm of the release mechanism is formed with a protruding portion on the other side opposite to the spring member, and the protruding portion abuts against a corresponding stop bar provided on the handle.

10. The digital torque wrench as claimed in claim 7, wherein the controller is further provided with a power supply assembled in the handle, and the power supply is coupled with the controller.

11. The digital torque wrench as claimed in claim 7, wherein the torque sensing element is a strain gauge.

12. The digital torque wrench as claimed in claim 7, wherein the roller and the rolling member are bearings.

13. The digital torque wrench as claimed in claim 7, wherein the release mechanism includes a plurality of rolling members, the rolling members being arranged parallel to each other.

14. A digital torque wrench, comprising:

a handle having an accommodation space formed therein;

a wrench main body provided with a tool head which is located at an exterior of the handle, the tool head is connected to one end of a transmission rod which is received in the accommodation space of the handle, and the transmission rod is pivotally connected with the handle; the other end of the transmission rod is formed with an abutment surface;

a torque sensing element assembled on the transmission rod of the wrench main body;

a release mechanism received within the accommodation space of the handle, the release mechanism is located at one end of the abutment surface of the transmission rod of the wrench main body; the release mechanism includes a lever arm which is pivotally connected with the handle; one end of the lever arm is correspondingly in contact with the abutment surface of the transmission rod; a roller is assembled on the other end of the lever arm and at least one rolling member opposite to the roller is assembled on the handle; an actuator is further provided, the transmission shaft of which is assembled with a bevel gear and is further provided with a cam, and the cam is formed with a bevel gear to mesh with the bevel gear of the actuator; a latch member is further provided and a follower is assembled on the latch member to be engage with the cam; a guide hole is provided on the latch member so as to allow a pilot bar assembled on the handle to go through; a spring member is fitted over the pilot bar and the spring member is located between the terminal head of the pilot bar and the latch member; and the latch member is inserted between the roller and the rolling member; and a control unit including a controller assembled on the handle, and the controller is coupled with the torque sensing element and the actuator of the release mechanism; a control interface and a digital display are provided on the exterior of the handle, and the control interface and the digital display are coupled with the controller.

15. The digital torque wrench as claimed in claim 14, wherein the lever arm of the release mechanism has a spring member provided on one end which abuts against the abutment surface of the transmission rod of the wrench main body, and the spring member is assembled between one side of the lever arm and the handle.

16. The digital torque wrench as claimed in claim 15, wherein the lever arm of the release mechanism is formed with a protruding portion on the other the opposite to the spring member, and the protruding portion abuts against a corresponding stop bar provided on the handle.

17. The digital torque wrench as claimed in claim 14, wherein the controller is further provided with a power supply assembled in the handle, and the power supply is coupled with the controller.

18. The digital torque wrench as claimed in claim 14, wherein the roller and the rolling member are bearings.

19. The digital torque wrench as claimed in claim 14, wherein the release mechanism includes a plurality of rolling members, the rolling members being arranged parallel to each other.

* * * * *